US010385544B2

(12) United States Patent
Lee et al.

(10) Patent No.: US 10,385,544 B2
(45) Date of Patent: Aug. 20, 2019

(54) METHOD AND DEVICE FOR CONTROLLING MAIN CONTROL VALVE OF CONSTRUCTION MACHINERY

(71) Applicant: Doosan Infracore Co., Ltd., Incheon (KR)

(72) Inventors: Taek-Jin Lee, Seoul (KR); Woo-Yong Jung, Seoul (KR); Ki-Yong Kim, Seoul (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 237 days.

(21) Appl. No.: 15/108,315

(22) PCT Filed: Dec. 24, 2014

(86) PCT No.: PCT/KR2014/012783
§ 371 (c)(1),
(2) Date: Sep. 26, 2016

(87) PCT Pub. No.: WO2015/099440
PCT Pub. Date: Jul. 2, 2015

(65) Prior Publication Data

US 2017/0121943 A1 May 4, 2017

(30) Foreign Application Priority Data

Dec. 26, 2013 (KR) ..... 10-2013-0164685

(51) Int. Cl.
*E02F 9/00* (2006.01)
*E02F 9/22* (2006.01)
(Continued)

(52) U.S. Cl.
CPC ..... *E02F 9/2228* (2013.01); *E02F 3/43* (2013.01); *E02F 9/2004* (2013.01); *E02F 9/2058* (2013.01); *G05G 9/047* (2013.01)

(58) Field of Classification Search
CPC ..... E02F 9/2228; E02F 3/43; E02F 9/2004; E02F 9/2058; G05G 9/047
(Continued)

(56) References Cited

U.S. PATENT DOCUMENTS 5,155,996 A * 10/1992 Tatsumi ..... E02F 9/2235 417/34
5,584,346 A * 12/1996 Sakamoto ..... E02F 9/2004 172/4.5
(Continued)

FOREIGN PATENT DOCUMENTS

JP 2007-285520 A 11/2007
KR 10-2005-0000820 A 1/2005
(Continued)

OTHER PUBLICATIONS

International Search Report for PCT/KR2014/012783 dated Feb. 17, 2015, citing the above reference(s).

*Primary Examiner* — Angelina Shudy
(74) *Attorney, Agent, or Firm* — Hauptman Ham, LLP

(57) ABSTRACT

In a method of controlling a main control valve in construction machinery, a first joystick signal for controlling a first control valve device and/or a second joystick signal for controlling a second control valve device are received from one joystick. While one of the first and second control valve devices operates, whether or not a joystick signal for controlling another of the first and second control valve devices is inputted is determined. A weighted value is applied to a threshold of valve operation initiation with respect to a joystick displacement to determine a raised threshold of valve operation initiation. If the inputted joystick displacement satisfies the raised threshold of valve operation initiation, a valve stoke corresponding to the inputted joystick displacement is calculated and outputted.

10 Claims, 11 Drawing Sheets

(51) Int. Cl.
*E02F 9/20* (2006.01)
*E02F 3/43* (2006.01)
*G05G 9/047* (2006.01)

(58) Field of Classification Search
USPC ..... 701/50
See application file for complete search history.

(56) References Cited

U.S. PATENT DOCUMENTS 6,435,289 B1* 8/2002 Hori ..... B62D 11/183 180/315
9,988,028 B2* 6/2018 Oosawa ..... B60T 8/4081
2010/0024410 A1* 2/2010 Brickner ..... E02F 9/2217 60/413
2012/0031088 A1* 2/2012 Takebayashi ..... E02F 9/2225 60/452
2014/0308106 A1* 10/2014 Beschorner ..... F15B 21/047 414/685
2014/0343805 A1* 11/2014 Suk ..... E02F 9/2285 701/50
2015/0298664 A1* 10/2015 Nimura ..... B60T 8/36 701/70
2015/0330058 A1* 11/2015 Lee ..... E02F 9/2242 701/50
2016/0040398 A1* 2/2016 Kitajima ..... E02F 3/435 701/50
2016/0069040 A1* 3/2016 Kami ..... E02F 3/437 701/50
2016/0069044 A1* 3/2016 Takaura ..... E02F 3/437 701/50
2016/0145827 A1* 5/2016 Kami ..... E02F 3/437 701/50
2016/0258135 A1* 9/2016 Shimano ..... E02F 3/435
2016/0265559 A1* 9/2016 Peterson ..... E02F 9/2217
2016/0265561 A1* 9/2016 Takahashi ..... F15B 11/17
2016/0376769 A1* 12/2016 Mori ..... E02F 9/2225 60/422
2017/0276155 A1* 9/2017 Hijikata ..... F15B 21/14
2018/0066417 A1* 3/2018 Kim ..... F15B 13/06
2018/0094406 A1* 4/2018 Kim ..... E02F 3/42

FOREIGN PATENT DOCUMENTS

KR 10-2009-0070167 A 7/2009
KR 10-2010-0044585 A 4/2010
KR 10-2011-0072587 A 6/2011
KR 10-2011-0072723 A 6/2011

* cited by examiner

METHOD AND DEVICE FOR CONTROLLING MAIN CONTROL VALVE OF CONSTRUCTION MACHINERY

CROSS REFERENCE TO RELATED APPLICATION

This application claims the priority of Korean Patent Application No. 10-2013-0164685, filed Dec. 26, 2013 in the Korean Intellectual Property Office. Further, this application is the National Phase application of International Application No. PCT/KR2014/012783, filed Dec. 24, 2014, which designates the United States and was published in Korean.

BACKGROUND

1. Field

Example embodiments relate to a method and a device for controlling a main control valve of construction machinery. More particularly, example embodiments relate to a control method and a control device for controlling a main control valve including at least two control valve devices controlled by one joystick.

2. Description of the Related Art

A hydraulic system in construction machinery may include a joystick. An operator manipulates the joystick to control a corresponding control valve device, thereby driving an actuator connected to the corresponding control valve device.

A general function of a joystick is explained with reference to FIG. 1. FIG. 1 is a view illustrating a joystick capable of controlling two control valves.

A manipulation device includes two joysticks J1 and J2, as illustrated in FIG. 1. The joystick may be manipulated in forward and backward directions and in right and left directions.

On the other hand, the construction machinery may include a linear type actuator and a rotary type actuator. The linear type actuator may operate to extend or retract. The rotary actuator may operate to rotate in clockwise or counterclockwise directions. The actuators may have two opposite motions, respectively.

Accordingly, one joystick J may generate a total of four signals of which two signals are used to operate one actuator, and thus one joystick J may control two actuators.

For example, as illustrated in FIG. 1, one joystick J1 may be used to control a boom and a bucket, and another joystick J2 may be used to control an arm and a swing motor.

If the joystick J, J1 is pulled backward, a boom actuator extends to raise the boom. If the joystick J, J1 is pushed forward, the boom actuator retracts to lower the boom. Similarly, if the joystick J, J1 is moved to the left, a bucket actuator extends to crowd the bucket. If the joystick J, J1 is moved to the right, the bucket actuator retracts to dump the bucket.

If the joystick J, J2 is pulled backward or pushed forward, an arm actuator extends or retracts. Similarly, if the joystick J, J2 is moved to the left or to the right, a swing motor rotates in clockwise or counterclockwise directions to swing an upper swing body.

FIGS. 2 and 3 are hydraulic circuit diagrams illustrating a hydraulic system including two control valve devices.

Referring to FIGS. 2 and 3, a hydraulic fluid is discharged from a pump P. The hydraulic fluid flows through a center bypass line L1. First and second control valve devices 10 and 20 are installed in the center bypass line L1.

A branch hydraulic line L2 branches from the center bypass line L1. Even when an upstream control valve operates, the hydraulic fluid can be supplied to a downstream control valve device through the branch hydraulic line L2. In here, the upstream and the downstream may refer to a relative position towards the pump P in the center bypass line L1.

A third control valve device 30 is installed to control a flow rate of the hydraulic fluid supplied to the second control valve device 20 through the branch hydraulic line L2. For example, when a more hydraulic fluid is required for another actuator, i.e., the boom actuator, the third control valve device 30 is operated. The third control valve device 30 is operated to reduce the flow rate of the hydraulic fluid supplied to the second control valve device 20, and thus, a more hydraulic fluid is supplied to another control valve device. As illustrated in FIG. 2, the third control valve device 30 is operated to reduce the flow rate of the hydraulic fluid supplied to the second control valve device 20 for controlling the bucket actuator, and thus a more hydraulic fluid is supplied to the first control valve device 10 for controlling the boom actuator.

In a convention method of controlling a main control valve, if an operator manipulates the joystick J with no mistakes, any problems may not occur.

However, when an operator manipulates the joystick with an intention to operate only one of the two control valve devices controlled by the joystick J, interference between the control valves may occur.

That is, even though an operator has an intention to operate only one control valve device, the joystick may be manipulated erroneously by an operator.

For example, even though an operator manipulates the joystick J to the left or to the right with an intention to operate only the bucket, the joystick J may be manipulated unintentionally forward or backward. Thus, when the operator has no intention to operate the boom, the boom may be operated unintentionally by the erroneous manipulation of the joystick.

The hydraulic circuit will be explained in detail with reference to FIGS. 2 and 3.

In order to operate the bucket, the joystick J is manipulated so that a bucket crowd pilot pressure (pi Bk cd) or a bucket dump pilot pressure (pi Bk dp) is applied to move a spool of the second control valve device 20. With an intention of the bucket crowd operation, the spool of the second control valve device 20 is shifted, and thus, the hydraulic fluid is supplied to a head-side chamber of the bucket actuator and the hydraulic fluid is discharged from a rod-side chamber of the bucket actuator.

In this case, when the joystick J is pushed unintentionally backward, as illustrated in FIG. 3, a boom up pilot pressure (pi Bm up) is applied to move a spool of the first control valve device 10. Thus, the first control valve device 10 is moved to close the center bypass line L1, the hydraulic fluid is supplied to the second control valve device 20 through the branch hydraulic line L2. That is, the boom may be operated unintentionally.

As mentioned above, even though an operator has an intention of a bucket single operation, the boom is operated unintentionally. The center bypass line L1 is closed and the hydraulic fluid is supplied to the second control valve device 20 through the branch hydraulic line L2, thereby pressure loss. The hydraulic fluid supplied to the second control valve device 20 may be reduced by an amount of the hydraulic fluid supplied to the boom actuator, so that the bucket operates unstably.

Accordingly, even though an operator has no intention to operate the boom, the joystick J is manipulated erroneously and thus the boom may be operated unintentionally and a desired precise bucket operation may not be obtained.

A conventional method of controlling a main control valve will be explained with reference to FIGS. 4 and 5.

FIG. 4 is a flow chart illustrating a conventional method of controlling a main control valve. FIG. 5 is a view illustrating the conventional method in FIG. 4.

A joystick is manipulated and then a joystick displacement amount is inputted to a controller (S110).

The controller receives the joystick displacement amount and then determines whether the received value has an intention to truly perform a single operation or a multiple operation. Even though an operator has an intention to truly perform the single operation, when a multiple joystick displacement amount is received, a minimum threshold criterion is applied. For example, when the maximum displacement amount of the joystick is set to 100%, only a joystick displacement amount of a predetermined value or more, for example, 1% to 5% or more, is determined as a true signal (S120). That is, the joystick displacement amount of less than the predetermined value is determined as a noise signal and is disregarded.

Then, a valve stroke is calculated based on the joystick displacement amount of the predetermined value or more (S130).

Then, after the valve stroke is determined, a command signal for controlling a control valve according to the determined valve stroke is outputted (S140). When the control valve device 10, 20 includes an electronic proportional pressure reducing valve, a current value signal is outputted as the command signal. The control valve device 10, 20 is shifted according to the current signal such that a hydraulic fluid is supplied to a corresponding actuator to perform a desired work.

Control situations in accordance with the conventional method of controlling a main control valve will be explained with reference to FIGS. 6 and 7.

FIG. 6 is a graph illustrating a valve stroke versus a joystick displacement in accordance with the conventional method of controlling a main control valve. FIG. 7 is a graph illustrating an actuator pressure versus a corresponding pump pressure in accordance with the conventional method of controlling a main control valve.

As illustrated in FIG. 6, when an operator manipulated a joystick J with an intention to operate an arm actuator and with no intention to operate a swing motor, a joystick input signal for driving the swing motor was unintentionally generated. As illustrated in FIG. 7, a great difference between a pressure of a pump and a pressure of a cylinder head side (head-side chamber) of a corresponding arm was observed.

This means that a portion of the hydraulic fluid discharged from the pump is supplied to the swing actuator, thereby causing pressure loss.

In the conventional control method of controlling a main control valve, an undesired control valve device may be operated unintentionally and thus a hydraulic fluid may be wasted to thereby decrease fuel efficiency.

The patent document below discloses a general technical concept of controlling a joystick.

[Patent Document]

Korean Patent Publication No. 10-2009-0070167 (2009 Jul. 1.)

SUMMARY

Example embodiments provide a control method and a control device for a main control valve in construction machinery capable of receiving a signal of a joystick displacement to control a corresponding control valve device so as to control two control valve devices with one joystick, wherein while one of the two control valves operates, whether a newly inputted joystick displacement signal is a true signal or not is determined, and an unintentional joystick displacement signal is disregarded and a true joystick displacement signal is used to control the corresponding control valve.

According to example embodiments, in a method of controlling a main control valve in construction machinery, a first joystick signal for controlling a first control valve device and/or a second joystick signal for controlling a second control valve device are received from one joystick. While one of the first and second control valve devices operates, whether or not a joystick signal for controlling another of the first and second control valve devices is inputted is determined. While one of the first and second control valve devices operates, if the joystick signal for controlling another of the first and second control valve devices is inputted, a weighted value is applied to a threshold of valve operation initiation with respect to a joystick displacement to determine a raised threshold of valve operation initiation. If the inputted joystick displacement satisfies the raised threshold of valve operation initiation, a valve stoke corresponding to the inputted joystick displacement is calculated and outputted.

In example embodiments, the first control valve device may include a bucket control valve and the second control valve device comprises a boom control valve.

In example embodiments, the first control valve device may include a bucket control valve and the second control valve device comprises a boom control valve.

In example embodiments, an offset time required to operate a corresponding actuator may be increased by the raised threshold of valve operation initiation.

In example embodiments, the raised threshold of valve operation initiation may be set to 15% or less of the maximum displacement value of the joystick.

In example embodiments, the raised threshold of valve operation initiation may be adjusted in proportion to a control valve stroke of the operating one of the first and second control valve devices.

In example embodiments, the minimum value of the raised threshold of valve operation initiation may correspond to the minimum value of the control valve stroke and the maximum value of the raised threshold of valve operation initiation may correspond to the maximum value of the control valve stroke.

According to example embodiments, a device for controlling a main control valve in construction machinery includes a input portion configured to receive a first joystick signal for controlling a first control valve device and/or a second joystick signal for controlling a second control valve device from one joystick, a processing portion configured to apply a weighted value to a threshold of valve operation initiation with respect to a joystick displacement to determine a raised threshold of valve operation initiation, if the joystick signal for controlling one of the first and second control valve devices is inputted, while another of the first and second control valve devices operates, and an output portion configured to calculate and output a valve stoke corresponding to the inputted joystick displacement if the inputted joystick displacement satisfies the raised threshold of valve operation initiation.

According to a method and a device for controlling a main control valve in construction machinery in accordance with example embodiments, when a joystick is manipulated to input a joystick displacement signal (%), it may be precisely determined whether the joystick displacement signal is a noise signal or a true signal for controlling a control valve.

Thus, an undesired actuator may be prevented from being operated erroneously to thereby perform a precise work.

Further, a hydraulic fluid may be prevented from being wasted to thereby improve fuel efficiency.

BRIEF DESCRIPTION OF THE DRAWINGS

Example embodiments will be more clearly understood from the following detailed description taken in conjunction with the accompanying drawings.

FIG. 1 is a view illustrating a joystick capable of controlling two control valves.

FIGS. 2 and 3 are hydraulic circuit diagrams illustrating a hydraulic system including two control valve devices.

FIG. 4 is a flow chart illustrating a conventional method of controlling a main control valve.

FIG. 5 is a view illustrating the conventional method in FIG. 4.

FIG. 6 is a graph illustrating a valve stroke versus a joystick displacement in accordance with the conventional method of controlling a main control valve.

FIG. 7 is a graph illustrating an actuator pressure versus a corresponding pump pressure in accordance with the conventional method of controlling a main control valve.

FIG. 8 is a flow chart illustrating a control method and a control device for a main control valve of construction machinery in accordance with example embodiments.

FIGS. 9 and 10 are views illustrating methods of determining a threshold of valve operation initiation with respect to a joystick displacement in accordance with example embodiments.

FIG. 11 is a graph illustrating a valve stroke versus a joystick displacement in accordance with an example embodiment.

FIG. 12 is a graph illustrating an actuator pressure versus a corresponding pump pressure in accordance with an example embodiment.

DETAILED DESCRIPTION OF EXAMPLE EMBODIMENTS

Figure 1:
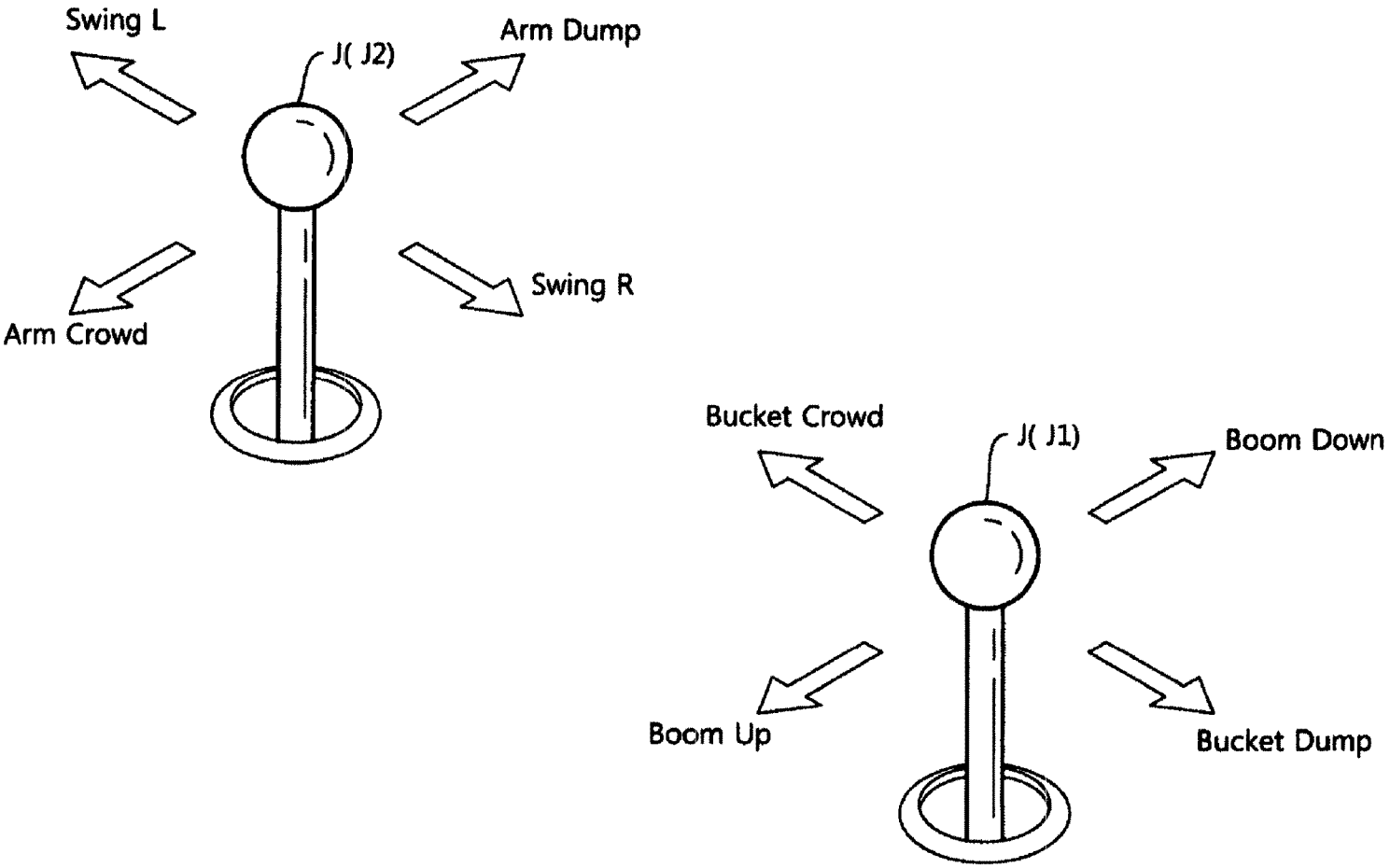
FIGS. 1 to 12 represent non-limiting, example embodiments as described herein.
Figure 2:
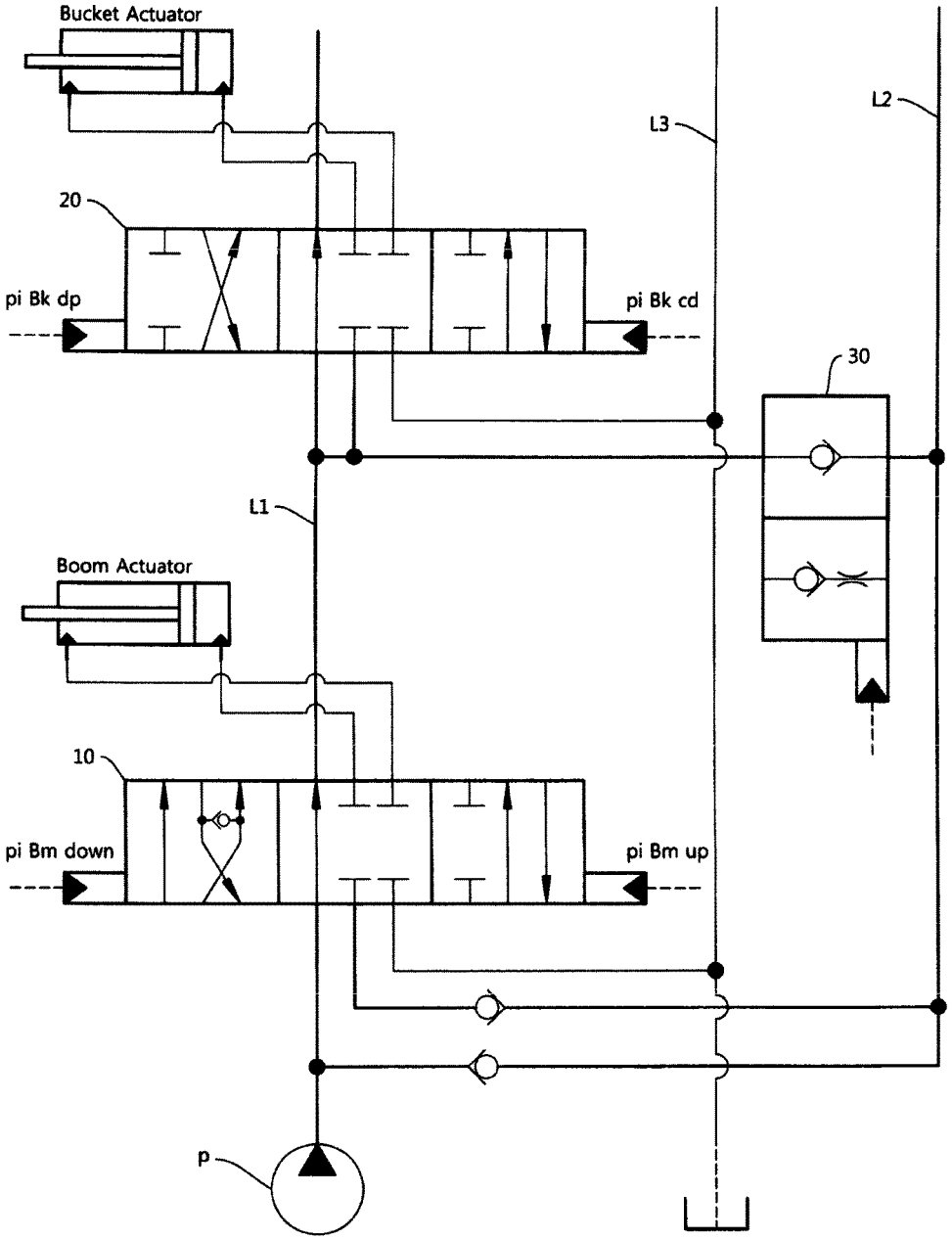
Figure 3:
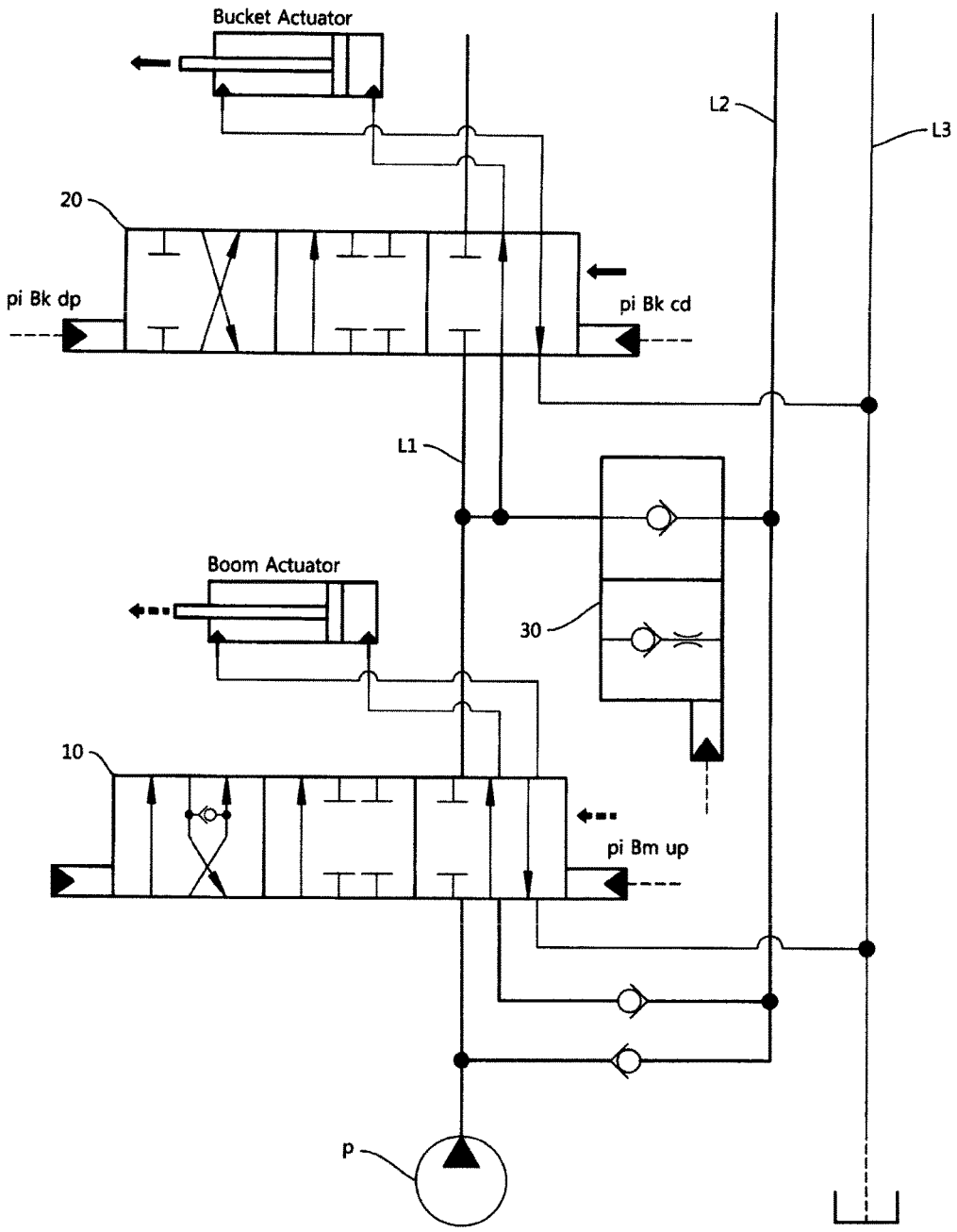
Figure 4:
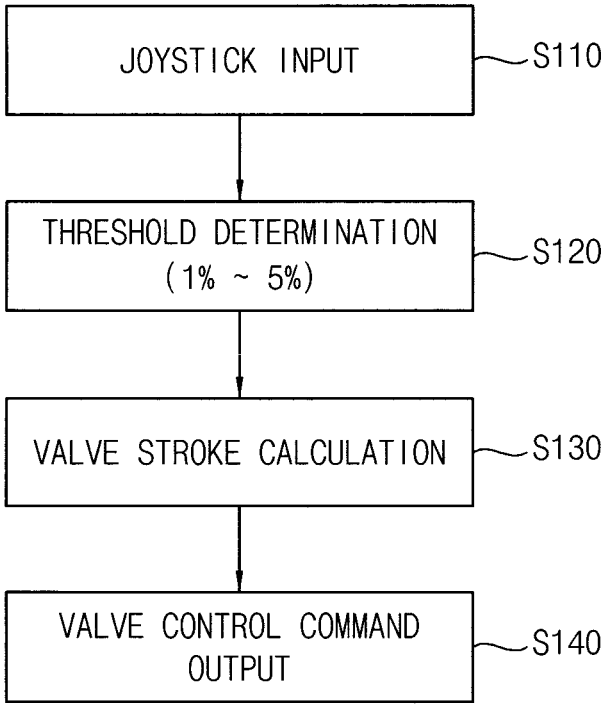
Figure 5:
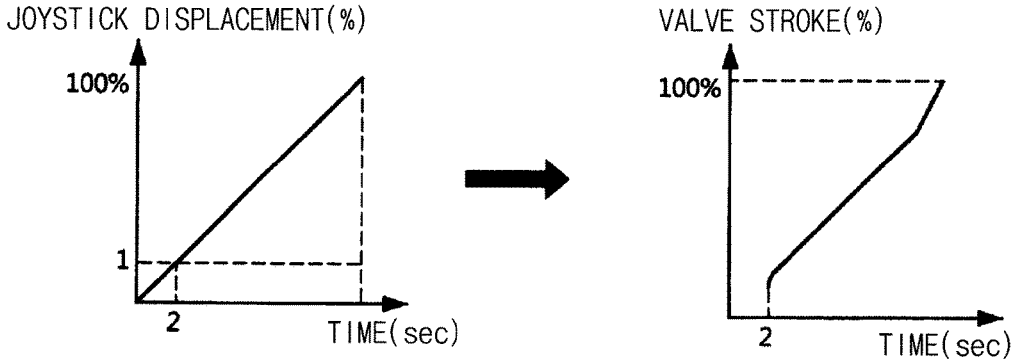
Figure 6:
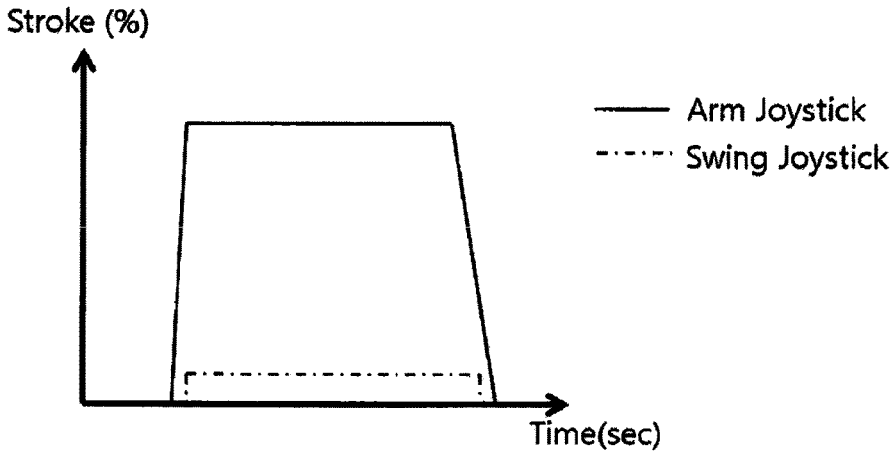
Figure 7:
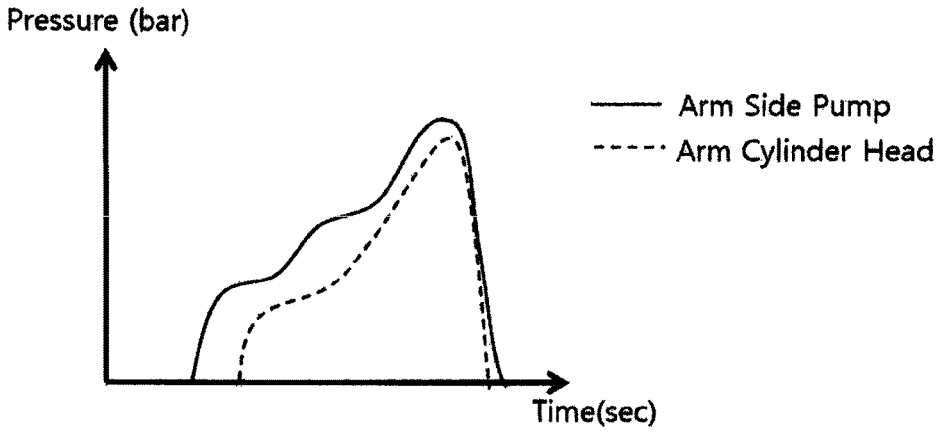

Various example embodiments will be described more fully hereinafter with reference to the accompanying drawings, in which example embodiments are shown. Example embodiments may, however, be embodied in many different forms and should not be construed as limited to example embodiments set forth herein. Rather, these example embodiments are provided so that this disclosure will be thorough and complete, and will fully convey the scope of example embodiments to those skilled in the art. In the drawings, the sizes and relative sizes of components or elements may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element or layer is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, example embodiments will be explained with reference to FIGS. 8 to 10.

Figure 8:
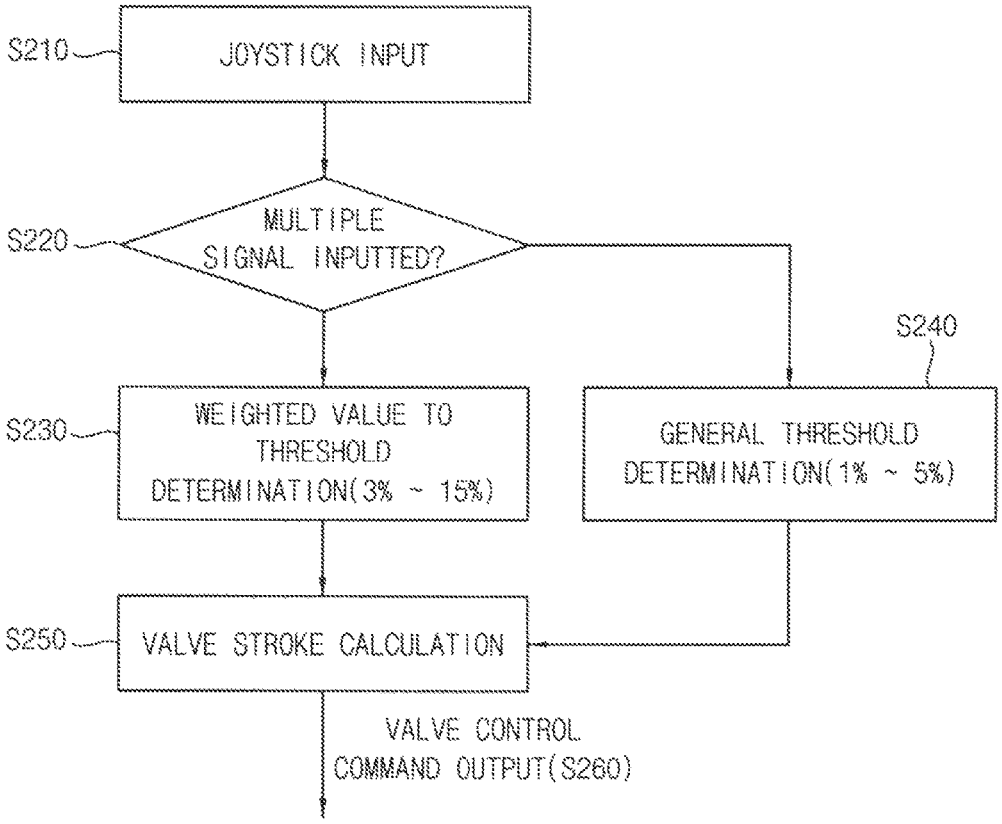

FIG. 8 is a flow chart illustrating a control method and a control device for a main control valve of construction machinery in accordance with example embodiments. FIGS. 9 and 10 are views illustrating methods of determining a threshold of valve operation initiation with respect to a joystick displacement in accordance with example embodiments.

Referring to FIG. 8, in a control device and control method according to example embodiments, a joystick may be manipulated and thus a joystick displacement value may be inputted, whether different joystick displacement values inputted together are a noise signal or a true signal may be determined and then interference between control valves sharing one joystick may be prevented.

First Step (S210): Signal Input Step

In a first step, a joystick may be manipulated and thus a joystick displacement amount may be inputted to an input portion of a control device. In particular, a first joystick input signal for controlling a first control valve device and a second joystick input signal for controlling a second control valve device may be inputted from one joystick. In here, the first and second control valve devices may be controlled by a manipulation of the one joystick.

A true multiple signal may be a signal that is generated by the manipulation of the joystick with an intention to operate two actuators together. A fake multiple signal may include a noise signal that is generated unintentionally by an erroneous manipulation of the joystick with an intention to operate only one actuator.

When an operator manipulates the joystick with no mistakes, precisely distinguishable first and second joystick signals may be inputted. In this case, the first joystick signal may have a relatively great joystick displacement amount and the second joystick signal may have a relatively small joystick displacement amount.

Second Step (S220): Multiple Signal Determination Step

In a second step, a processing portion of the control device may determine whether or not, while one of the first and second control valve devices operates, a joystick signal for controlling another of the first and second control valve devices is inputted.

Joystick displacement values (first joystick signal and second joystick signal) for controlling a control valve device may be inputted to the control device together. Alternatively, one joystick signal having a relatively great value and another joystick signal having a relatively small value may be inputted.

In the second step, whether the inputted signal is a multiple signal or a single signal may be determined.

Third Step (S230): Application Step of Weighted Value to Threshold

In a third step, while one of the first and second control valve devices operates if the joystick signal for controlling another of the first and second control valve devices is inputted, a weighted value may be applied to a first threshold for valve operation initiation with respect to a joystick displacement to adjust and determine a second threshold for valve operation initiation greater than the first threshold.

In the third step, when the inputted signal is determined as the multiple signal by the second step, the weighted value may be applied to the first threshold for valve operation initiation with respect to the joystick signal value having a relatively small joystick displacement amount of the first and second joystick signals.

The second threshold for valve operation initiation may be raised up to about 3% to 15% of the total joystick input displacement range. The very small inputted value less than about 3% may be disregarded as an erroneous manipulation. On the other hand, when the second threshold is set to 15%, a valve response may become too late. That is, an offset time required to operate a corresponding actuator after manipulating the joystick may be increased. Accordingly, the second threshold may be set to preferably about 15% or less.

As described below, the application of the weighted value to the threshold for valve operation initiation will be explained in detail with reference to FIGS. 9 and 10.

Fourth Step (S240): Application Step of General Threshold

In a fourth step, when the second step determines that the inputted signal is the single signal, a general threshold (first threshold) may be applied to the joystick signal value having a relatively small joystick displacement amount of the first and second joystick signals. The first threshold may be set to about 1% to 5% of the total joystick input displacement range.

Fifth Step (S250): Valve Stroke Calculation Step

In a fifth step, after the third and fourth steps, a true signal of the first and second joystick signals according to the joystick displacement amount may be calculated as a valve stroke.

That is, when the two signals are true, pilot signals of controlling two control valve devices may be generated.

When any one of the two signals is a noise signal, only one joystick displacement value corresponding to the true signal may be calculated for a valve stroke and thus a pilot signal corresponding to the calculated valve stroke may be generated.

Sixth Step (S260): Valve Control Command Output Step

In a sixth step, an output portion of the control device may output the pilot signal generated in the fifth step.

When the control valve device includes a linear solenoid valve, the pilot signal may include a current signal. That is, the current may be applied to the solenoid valve, and then the solenoid valve may shift a spool of the control valve device by a distance corresponding to the current value.

When the spool of the control valve device is controlled by a pilot oil, the pilot signal may include a pilot pressure. That is, the pilot pressure may be applied to a pressure receiving portion of the control valve device, and then the spool of the control valve device may be shifted by a distance corresponding to the pilot oil.

Hereinafter, a method of applying the weighted value to the threshold of valve operation initiation will be explained.

First, two control valve devices controllable by one joystick may be prepared. The threshold of valve operation initiation (first threshold) for each of two control valves may be set to about 1% to 5% of the maximum displacement value of the joystick. The first threshold may be used for a minimum threshold criterion.

As mentioned above, while one of the two control valve devices operates, the joystick may be manipulated to newly generate a joystick displacement value for operating another of the two control valve devices. In order to determine whether the newly inputted joystick displacement value is a noise value or a true value, the first threshold may be raised up to a new second threshold. The second threshold may be set to about 3% to 15% of the maximum displacement value of the joystick.

First Embodiment Step Control

A first threshold for one control valve may be adjusted based on an operation (On/Off) of another control valve. If one control valve operates (On), a weight value may be applied to the first threshold with respect to a joystick displacement for another control valve to determine a second threshold greater than the first threshold. In here, the newly set second threshold may be tuned in consideration of dynamics of the construction machinery.

Figure 9:
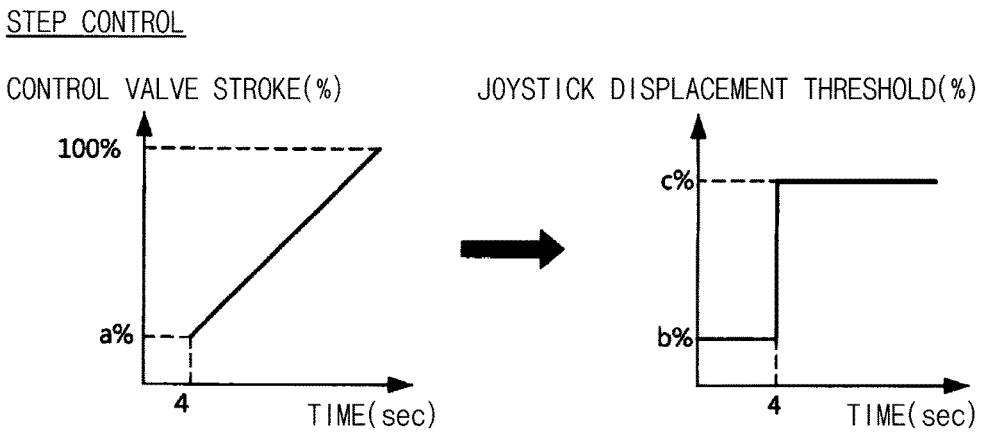

As illustrated in FIG. 9, a control valve stroke (%) may be set to have a predetermined range of the total control valve stroke. For example, the minimum value of the control valve stroke (%) may be set to a % and the maximum value of the control valve stroke (%) may be set to 100%. The first threshold with respect to a joystick displacement may be set to b % and the raised second threshold may be set to c %. Accordingly, while one valve of the two control valve devices controllable by one joystick operates, the first threshold for another valve may be adjusted to be raised up to the second threshold.

For example, the maximum value of the second threshold may be set to 15% of the maximum displacement value of the joystick. If the second threshold is set to a relatively high value, a response of the control valve unit may become insensitive to a joystick manipulation. Accordingly, the second threshold may be limited to preferably 15% or less.

Second Embodiment Linear Control

If one control valve operates (On), a first threshold with respect to a joystick displacement for another control valve may be adjusted to a second threshold in proportion to a spool displacement of the one operating control valve. In here, the proportional ratio may be tuned in consideration of dynamics of the construction machinery.

Figure 10:
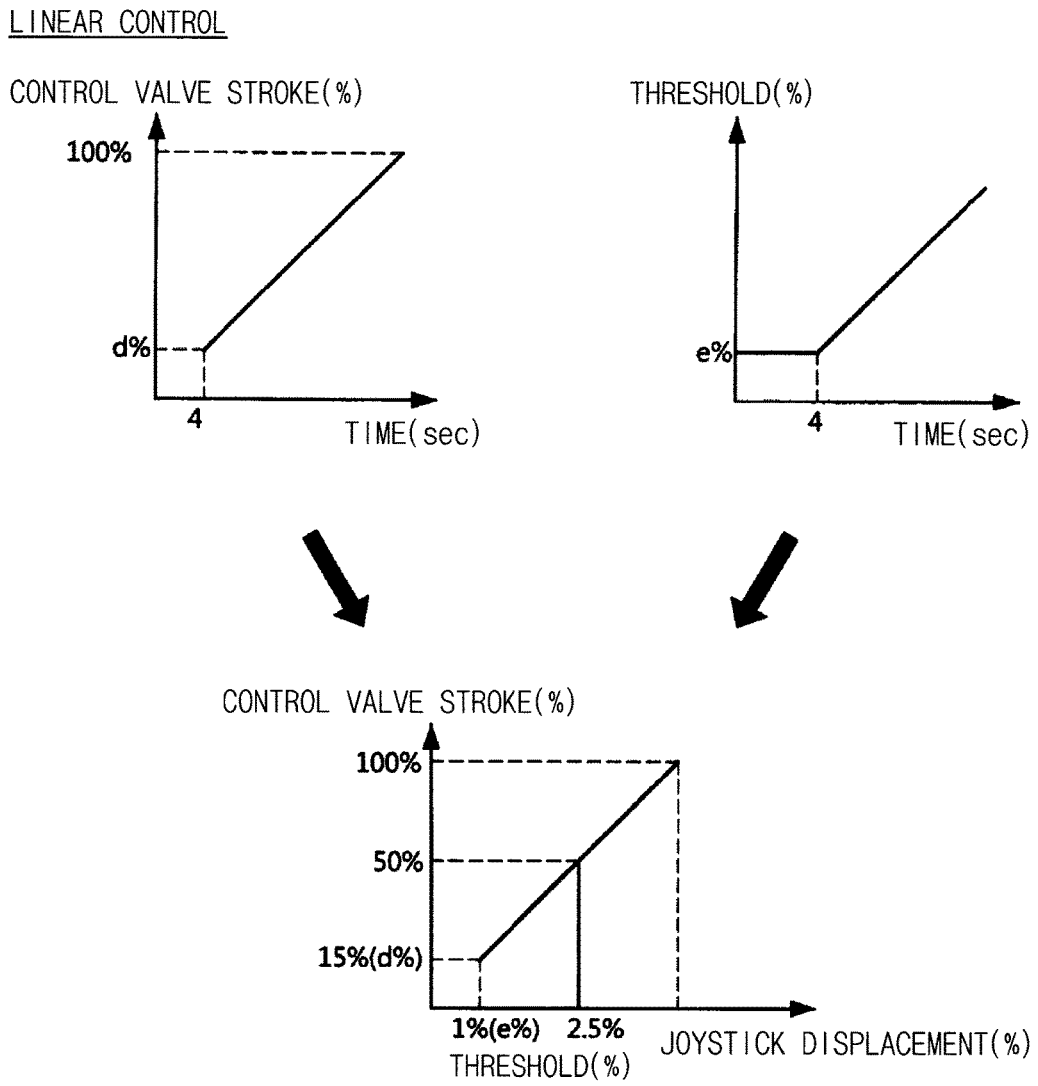

As illustrated in FIG. 10, a control valve stroke (%) may be set to have a predetermined range of the total control valve stroke. For example, the minimum value of the control valve stroke (%) may be set to d % and the maximum value of the control valve stroke (%) may be set to 100%. The minimum value of the second threshold with respect to a joystick displacement may be set to e % and the maximum value of the second threshold may be set to 100%. Accordingly, if one valve of the two control valve devices controllable by one joystick operates rapidly, it may be more likely that an operator manipulates erroneously the joystick. Thus, the first threshold for another valve may be adjusted up to the second threshold in proportion to the displacement of the one valve.

For example, if the minimum value (d) of the control valve stroke may be set to 15% and the second threshold (e) with respect to a joystick displacement may be set to 1% corresponding to the minimum value of the control valve stroke, as the control valve stroke is increased from 15% to 100%, the second threshold with respect to a joystick displacement may be controlled to raised from 1% to 100% in proportion to the control valve stroke.

That is, when the control valve stroke (%) is 15%, the joystick displacement (%) of 1% or more may be determined as a true signal. Alternatively, when the control valve stroke (%) is 50%, the joystick displacement (%) of 3% or more may be determined as a true signal.

Third Embodiment Table Control

Values for a threshold may be set for each section of a control valve stroke (%) and may be provided a table. That is, when the control valve stroke reaches in a specific section, a threshold value corresponding to the specific section may be set to as a second threshold.

For example, the control valve stroke may be divided into a plurality of sections (for example, first to fifth sections) between the minimum value and the maximum value, and values for the second threshold may be determined corresponding to the sections respectively. For example, when the control valve stroke in a second section, a threshold value corresponding to the second section may be set to as the second threshold.

Hereinafter, control situations in accordance with a method of controlling a main control valve in accordance with example embodiments will be explained with reference to FIGS. 11 and 12.

Figure 11:
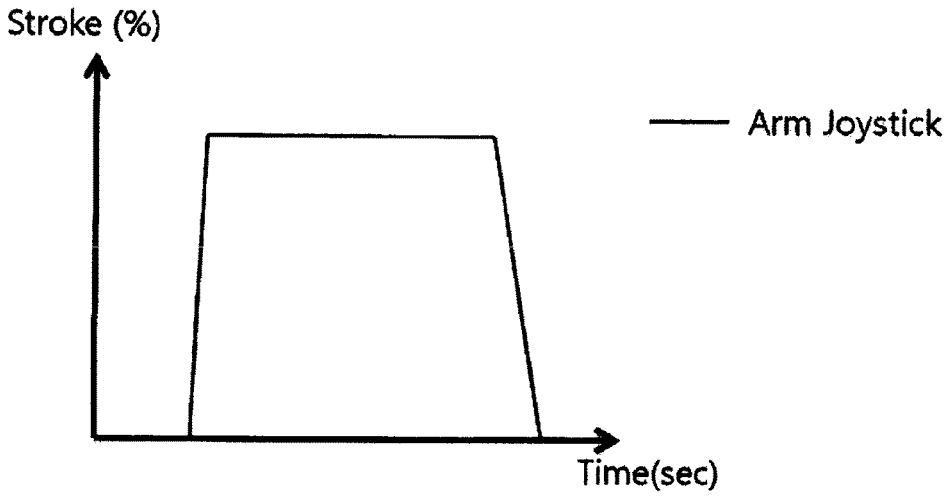
Figure 12:
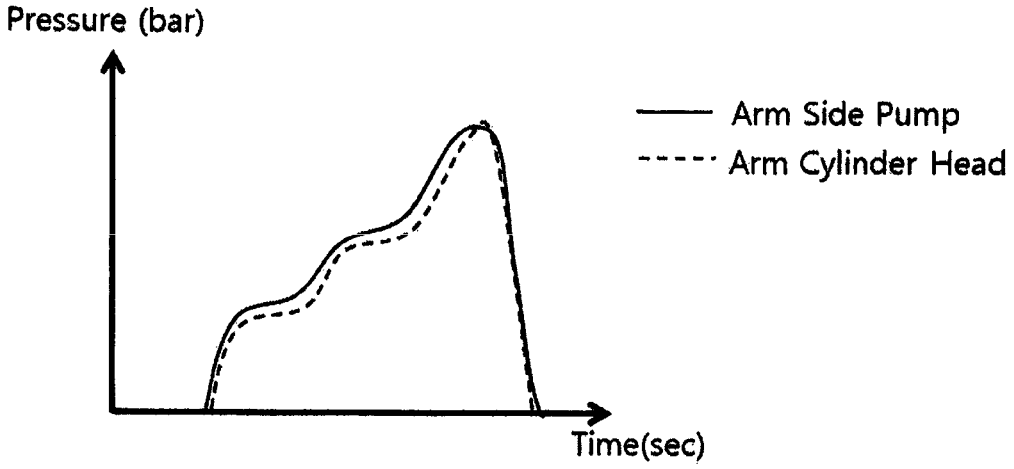

FIG. 11 is a graph illustrating a valve stroke versus a joystick displacement in accordance with an example embodiment. FIG. 12 is a graph illustrating an actuator pressure versus a corresponding pump pressure in accordance with an example embodiment.

As illustrated in FIG. 11, when an operator manipulates a joystick J with an intention to operate an arm actuator and with no intention to operate a swing motor, a weighted value may be applied to a threshold of valve operation initiation to remove interference between the valves, so that a joystick input signal for driving the swing motor may not be generated. Accordingly, as illustrated in FIG. 12, a difference between a pressure of a pump and a pressure of a cylinder head side of a corresponding arm may be hardly observed.

This means that almost all hydraulic fluid discharged from the pump is supplied to the desired actuator, that is, the arm actuator, thereby preventing pressure loss.

In example embodiments, a desired control valve device may be operated and an undesired control valve device may be prevented from being operated. Thus, a hydraulic fluid may be prevented from being supplied to an undesired actuator, to thereby improve fuel efficiency.

In a control method for a main control valve in construction machinery in accordance with example embodiments, when a joystick is manipulated to input a joystick displacement signal (%), it may be precisely determined whether the joystick displacement signal is a noise signal or a true signal for controlling a control valve.

Thus, an undesired actuator may be prevented from being operated erroneously to thereby perform a precise work. Further, a hydraulic fluid may be prevented from being wasted to thereby improve fuel efficiency.

The foregoing is illustrative of example embodiments and is not to be construed as limiting thereof. Although a few example embodiments have been described, those skilled in the art will readily appreciate that many modifications are possible in example embodiments without materially departing from the novel teachings and advantages of the present invention. Accordingly, all such modifications are intended to be included within the scope of example embodiments as defined in the claims.

INDUSTRIAL APPLICATION

In a control method and a control device for a main control valve in construction machinery in accordance with example embodiments, when at least two control valve devices are controlled by one joystick, an undesired control valve device may be prevented from being operated unintentionally.

DESCRIPTION OF REFERENCE NUMERALS

J, J1, J2: joystick
P: pump
10, 20, 30: first, second and third control valve devices
L1: center bypass line
L2: branch hydraulic line
L3: exhaust hydraulic line

What is claimed is:

1. A method of controlling a main control valve including at least two control valve devices controlled by one joystick in construction machinery, comprising:

receiving, from said one joystick, a first joystick signal for controlling a first control valve device or a second joystick signal for controlling a second control valve device, wherein both the first joystick signal and the second joystick signal are generated based on an amount of a joystick displacement when the joystick displacement is inputted to control the first control valve device or the second control valve device;

determining, while the first control valve device operates and is controlled by the first joystick signal, whether a signal is inputted from said one joystick;

determining whether the inputted signal is a noise signal or corresponds to the second joystick signal to control the second control valve device;

adjusting a threshold for initiating a valve operation with respect to a joystick displacement by applying a weighted value to a predetermined threshold of valve operation initiation, when the second joystick signal is determined to be inputted while the first control valve device operates and is controlled by the first joystick signal;

calculating and outputting a valve stroke corresponding to the inputted joystick displacement when the inputted joystick displacement satisfies the threshold adjusting for initiating the valve operation; and controlling the main control valve including the first control valve device and the second control valve device based on the valve stroke calculated.

2. The method of claim 1, wherein the first control valve device comprises a bucket control valve and the second control valve device comprises a boom control valve.

3. The method of claim 1, wherein an offset time required to operate a corresponding actuator is increased by the threshold for initiating the valve operation.

4. The method of claim 1, wherein the threshold for initiating the valve operation is set to 15% or less of the maximum displacement value of the joystick.

5. The method of claim 1, wherein the threshold for initiating the valve operation is adjusted in proportion to a control valve stroke of the operating one of the first and second control valve devices.

6. The method of claim 5, wherein the minimum value of the threshold for initiating the valve operation corresponds to the minimum value of the control valve stroke and the maximum value of the threshold for initiating the valve operation corresponds to the maximum value of the control valve stroke.

7. A device for controlling a main control valve including at least two control valve devices controlled by one joystick in construction machinery, the device configured to:

receive, from said one joystick, a first joystick signal for controlling a first control valve device or a second joystick signal for controlling a second control valve device, wherein both the first joystick signal and the second joystick signal are electric signals which are generated based on an amount of a joystick displacement when the joystick displacement is inputted to control the first control valve device or the second control valve device;

determine, while the first control valve device operates and is controlled by the first joystick signal, whether a signal is inputted from said one joystick, determine whether the inputted signal is a noise signal or corresponds to the second joystick signal to control the second control valve device, and adjust a threshold for initiating a valve operation with respect to a joystick displacement by applying a weighted value to a predetermined threshold of valve operation initiation, when the second joystick signal is determined to be inputted while the first control valve device operates and is controlled by the first joystick signal; and calculate and output a valve stroke corresponding to the inputted joystick displacement when the inputted joystick displacement satisfies the threshold for initiating the valve operation.

8. The device of claim 7, wherein the threshold for initiating the valve operation is set to 15% or less of the maximum displacement value of the joystick.

9. The device of claim 7, wherein the threshold for initiating the valve operation is adjusted in proportion to a control valve stroke of the operating one of the first and second control valve devices.

10. The device of claim 9, wherein the minimum value of the threshold for initiating the valve operation corresponds to the minimum value of the control valve stroke and the maximum value of the threshold for initiating the valve operation corresponds to the maximum value of the control valve stroke.

* * * * *